US007181819B2

(12) United States Patent
Marlow, Jr. et al.

(10) Patent No.: US 7,181,819 B2
(45) Date of Patent: Feb. 27, 2007

(54) DUCTMATE CLIP SETTER

(76) Inventors: Leonard G. Marlow, Jr., PO Box 4317, Chino Valley, AZ (US) 86323; William M. Owens, PO Box 2396, Chino Valley, AZ (US) 86323

( * ) Notice: Subject to any disclaimer, the term of this patent is extended or adjusted under 35 U.S.C. 154(b) by 0 days.

(21) Appl. No.: 11/093,193

(22) Filed: Mar. 30, 2005

(65) Prior Publication Data

US 2006/0218766 A1 Oct. 5, 2006

(51) Int. Cl.
*B25B 1/14* (2006.01)

(52) U.S. Cl. ..... 29/243.56

(58) Field of Classification Search ..... 294/7, 294/11, 12, 9, 6, 17, 26; 29/243.56, 243.57, 29/267

See application file for complete search history.

(56) References Cited

U.S. PATENT DOCUMENTS

| | | | | |
|---|---|---|---|---|
| 1,740,158 | A * | 12/1929 | Dinklage | 29/267 |
| 4,999,898 | A * | 3/1991 | Schmeling | 29/243.56 |
| 5,020,202 | A * | 6/1991 | Turrell | 29/243.56 |
| 6,925,697 | B2 * | 8/2005 | Kratz | 29/267 |
| 6,957,476 | B2 * | 10/2005 | Poutre' et al. | 29/267 |

* cited by examiner

*Primary Examiner*—Robert C. Watson
(74) *Attorney, Agent, or Firm*—Charles R. Sutton

(57) ABSTRACT

A compact, easy-to-use, hand tool which is made for the use of installing "Ductmate Clips" on Heating and Air Conditioning sheet metal ductwork utilizing a "Ductmate", "TDC", or "TDF" assembly system. The tool is further used in the removal of said "Ductmate Clips", when ductwork demolition is required.

8 Claims, 4 Drawing Sheets

DUCTMATE CLIP SETTER

REFERENCES

No references were found in patent searches.

FIELD OF THE INVENTION

This invention relates to a hand tool used for setting the locking clips used to attach two pieces of sheet metal ductwork comprising of "TDC", "TDF", or "Ductmate" assembly systems.

BACKGROUND OF THE INVENTION

Rectangular Heating and Air Conditioning ductwork is assembled or attached together to form a chain to deliver conditioned air from an Air Handler to specific points in a building. The Ductwork is assembled by one of two means known widely in the art. The first means is by the use of "S-Lock" and "Drive-Lock" cleats, which will not be the subject of this invention. The second means incorporates the use of flanges, known in the art as "Ductmate", "TDC", or "TDF". This ductwork is bolted together at each corner, and then the center portions of the ductwork between the corners is either screwed together or clips may be installed to pull the center sections of the flanges together to provide an air tight seal.

Screwing the flanges together is very labor intensive and increases material costs. An alternative to screwing the flanges together is to install, what is commonly known, as "Clips". The clips sandwich the two opposing flanges together with a ribbon type gasket between the flanges. The clip has an indent on both sides, one side of the clip is longer than the opposing side, and a flat portion on the top, the indents lock in place by encapsulating sheet metal beads formed on each flange. Current technology uses a common tool known in the art as "Vice Grips" to squeeze the flanges together on each side of the "clip", setting the "clip" in place and then using another tool commonly known as "Channel Locks" to roll the clip into place. This process is also very labor intensive and requires the use of three tools. The "Channel Lock Pliers' have a strong tendency to slip and twist the clip, rendering the clip unusable. The most common "clips" used in the art are approximately six inches in length and may require several "clips" on each side of the ductwork. The use of "Channel Lock Pliers" also requires the need for "squeezing" the indents in and under the beads on the flange to lock the "clip" in place.

SUMMARY OF THE INVENTION

The hand tool of this invention provides a single hand tool that will hold the "clip" on one side of the flanges and by applying a small amount of pressure at the right point on the 'clip", will snap the clip over the other flange. Locking the clip on the flanges and providing an air tight seal for the attached ductwork. The tool in this invention eliminates the need for screwing the flanges together and eliminates the possibility of twisting the "clips" and rendering the "Clips" unusable. The hand tool in this invention allows the operator to install clips of various lengths and sizes without a change in tool setting or size. By not distorting the "clip", the hand tool of this invention eliminates the need for "squeezing" the indents on the sides of the "clip" to lock the "clip" in place. The hand tool of this invention, by reversing the process of installation, may also be used to remove the clips when the ductwork needs to be disassembled.

DESCRIPTION OF THE PREFERRED EMBODIMENT

Figure 1:
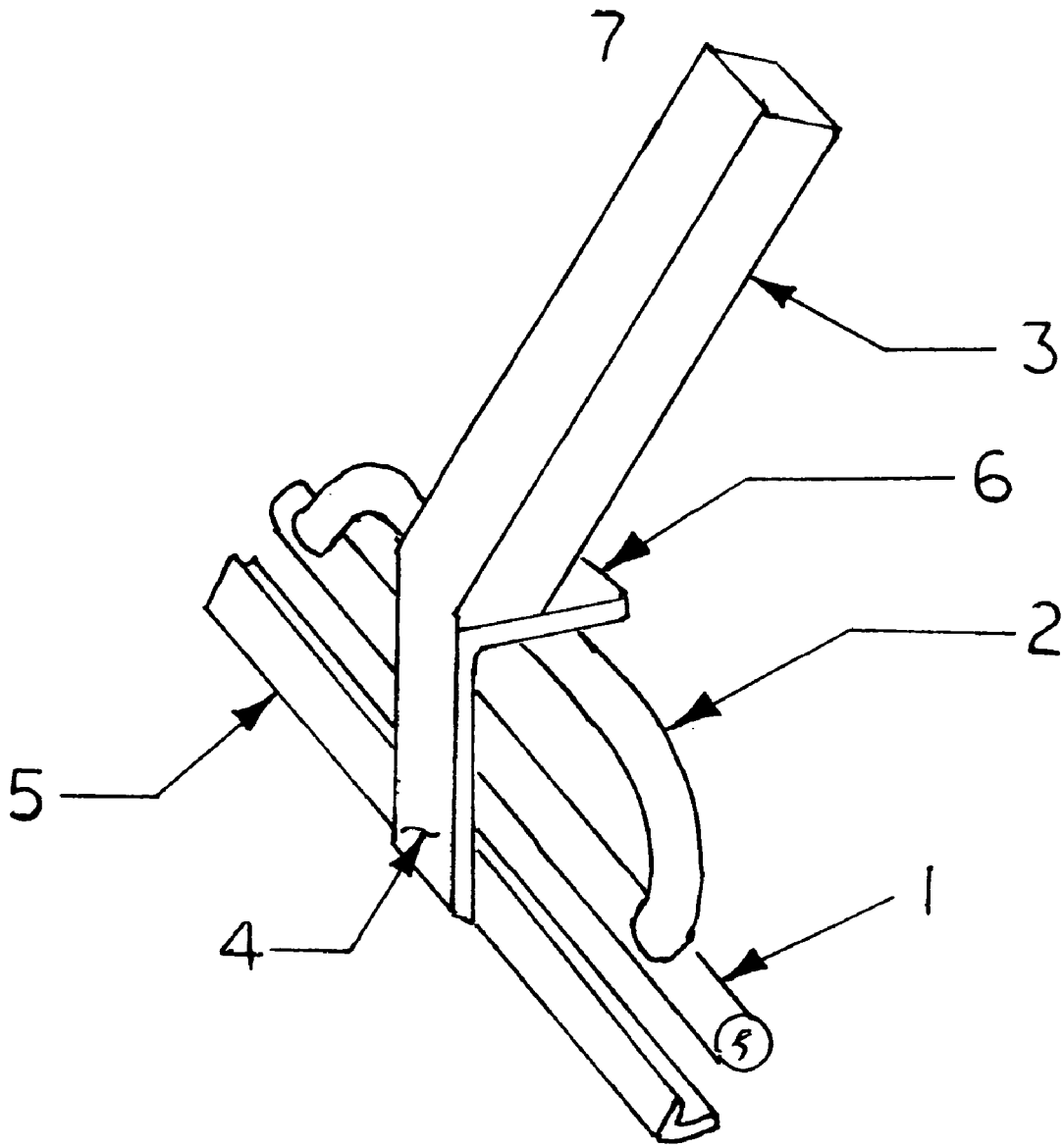
FIG. 1 is an isometric drawing of the hand tool of the present invention showing the true relationship of the components included in the hand tool.
Figure 2:
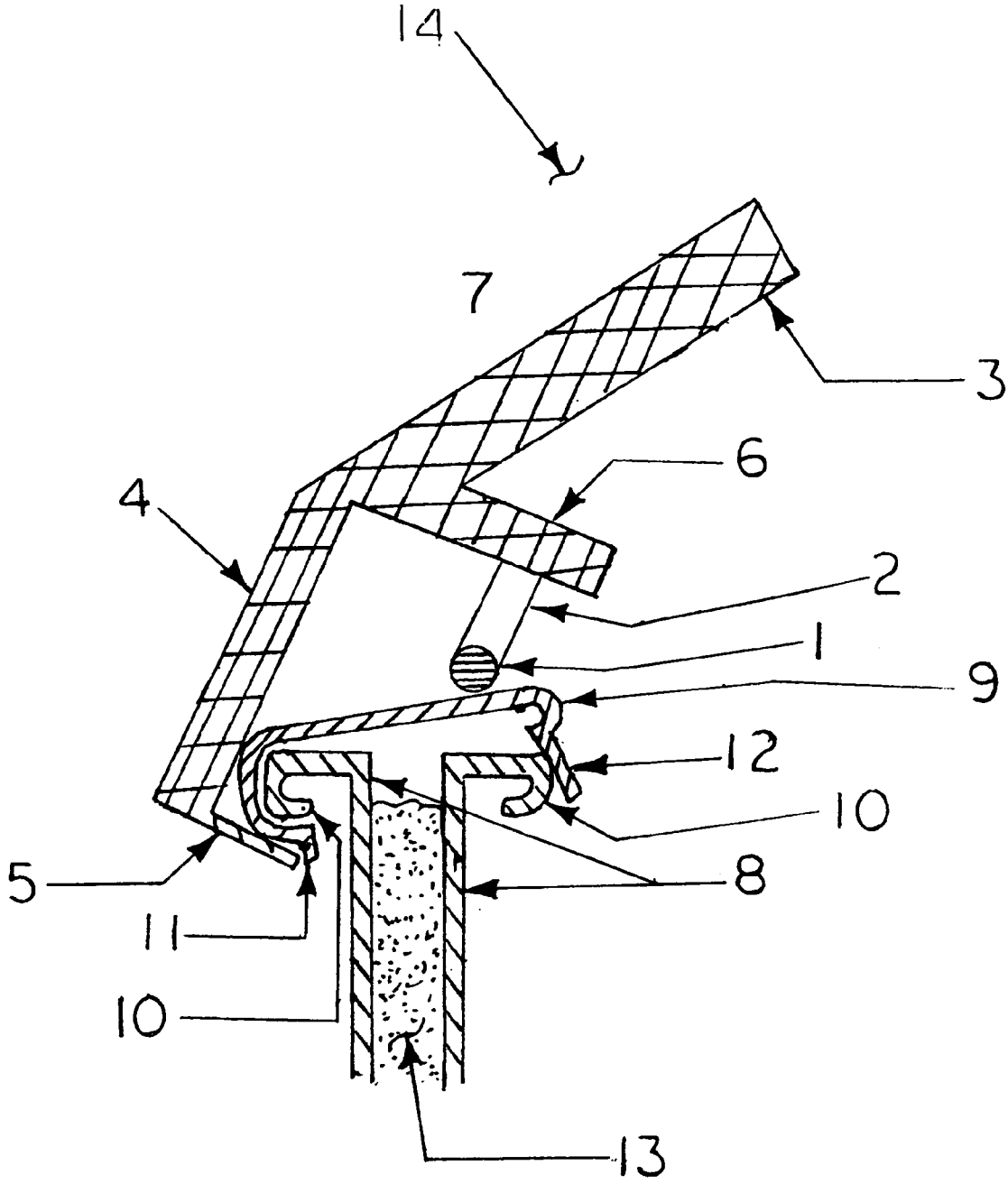
FIG. 2 is a cross-sectional view of the Ductwork flanges, Ductwork flange beads, gasket material, "clip", and the hand tool placement prior to the clip installation, and direction of force required to snap the "clip" into place.

Referring to FIG. 1, a preferred embodiment of the hand tool of the present invention is referred to generally as numeral (7). At one end of the tool (7) is a setting rod (1) which is preferably of cylindrical shape, the diameter and length of the setting rod (1) may be any size and length suitable for distributing the force required to snap a "clip" into place. Also, along this end of the tool is a base lock (5) which runs parallel to the setting rod (1), the length of the lock base (5) is preferably the same length as that of the setting rod (1). The base lock (5) is preferably L-shaped, suitable for holding the indent (11) in place as shown in FIG. 2. The distance between the setting rod (1) and the lock base (5) is preferably a distance that will allow the setting rod (1) to rest in a position directly above and just behind the fold of indent (12) shown on FIG. 2. Further the base lock (5) is supported by an arm (4) that connects the base lock (5) to a bridge (6). The setting rod (1) is supported by a brace (2) which is preferably an arch shape, but may be any shape and size suitable for distributing the applied force equally to the setting rod (1). The brace (2) connects the setting rod (1) to the bridge (6). The bridge (6) connects and holds in place the arm (4), brace (2) and the handle (3). The bridge (6) is positioned perpendicular to the arm (4) and the brace (2) to maintain the desired distance and position of the arm (4) and brace (2). The handle (3) is set preferably at an angle away from perpendicular to the bridge (6). The handle (3) is preferably of a length and shape that is suitable for obtaining a firm grip by a human hand.

Referring to FIG. 2, the clip (9) is positioned on the flanges (8), such that indent (11), the shorter of the two indents, is locked onto the flange bead (10) of either flange. The base lock (5) is positioned in relation to the flanges (8) and the clip (9) such that the base lock (5) holds the "clip" indent (11) in a locked position, The setting rod (1) is then positioned in a resting manner over the clip indent (12). An operator can then apply force on the handle (3) in the direction of force arrow (14).

Figure 3:
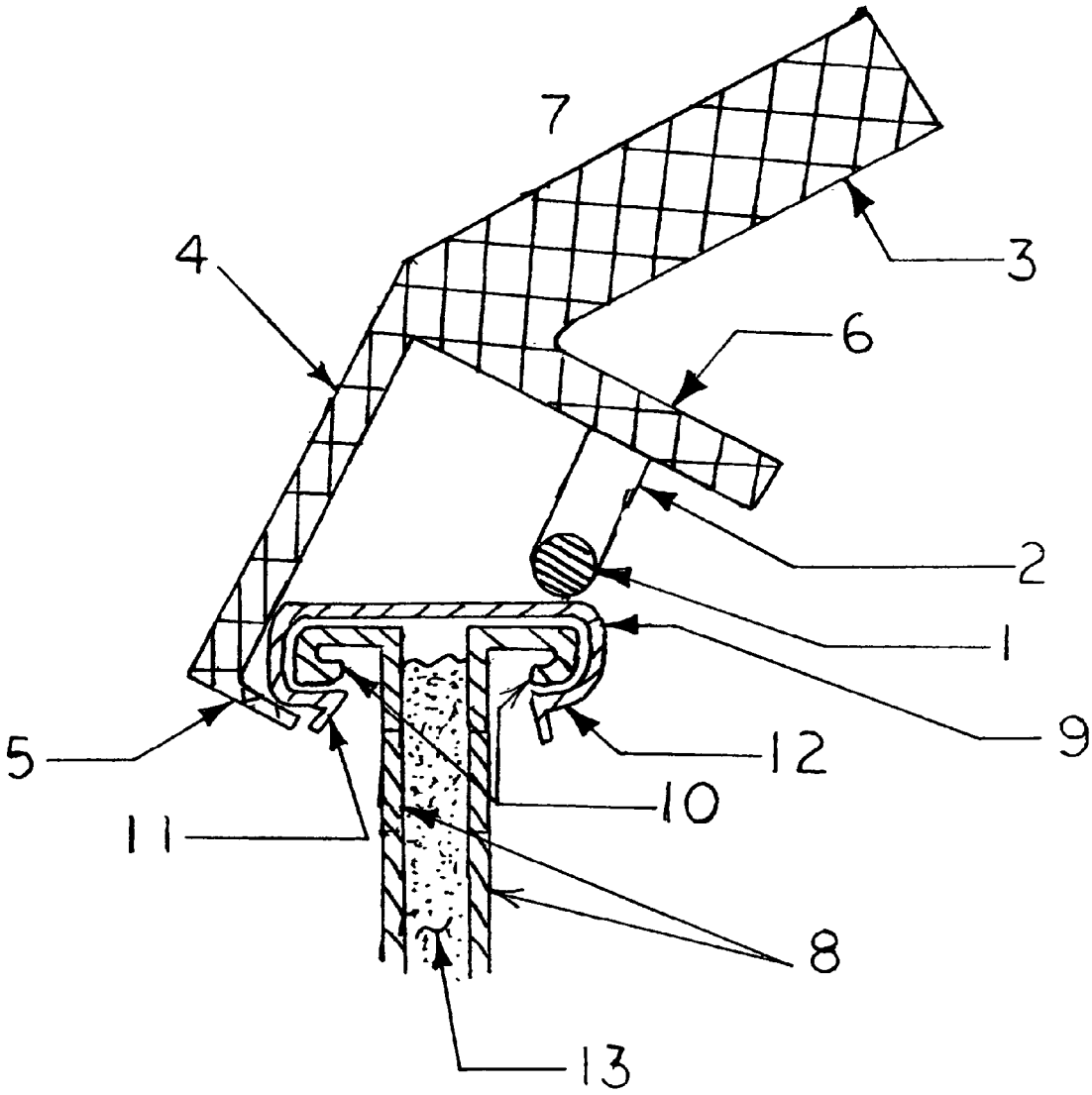
FIG. 3 is a cross-sectional view of the Ductwork flanges, gasket material, "clip", and the position of the hand tool immediately after the "clip" installation.

Referring to FIG. 3, as force is applied to the handle (3), the clip indent (12) will expand outward and down until clip indent (12) snaps over the flange bead (10), locking the "clip" (9) on both sides of the flanges beads (10), and compressing the gasket material (13) between the flanges (8) creating an air tight seal.

Figure 4:
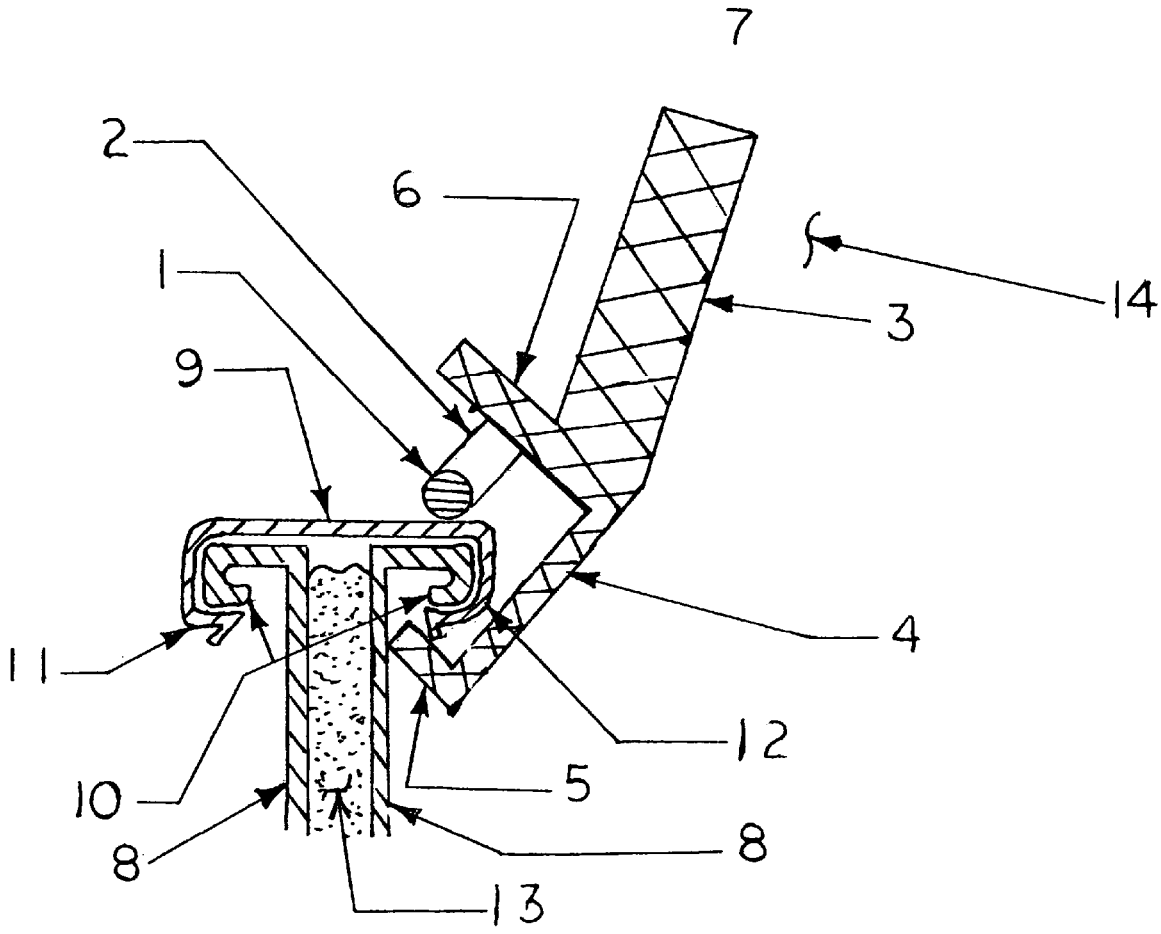
FIG. 4 is a cross-sectional view of the Ductwork flanges, gasket material, "clip", and the positioning of the hand tool prior to "clip" removal, and direction of force applied to remove the installed "clip".

Referring to FIG. 4, the base lock (5) is positioned on the "clip" (9) such that the base lock (5) is under the clip indent (12). The setting rod (1) is rested over the flat portion of the "clip" (9), and by applying force in the direction of force arrow (14), the clip will be released from it's locked position and can be removed.

What is claimed:

1. A Ductmate clip setting tool comprising a handle with a bridge fixedly attached to said handle; said bridge having an arm and a brace located opposite each other on parallel planes; said arm having a lock base fixedly attached to said arm; said brace having a setting rod fixedly attached to said brace; said setting rod and said lock base are positioned parallel to each other and perpendicular to said handle; said setting rod and said lock base being elongate and substantially the same length.

2. The Ductmate clip setting tool of claim 1 wherein the said handle is of such size, shape and length to obtain a firm and comfortable grip by a human hand.

3. The Ductmate clip setting tool of claim 1 wherein the said handle and said bridge are made of the same continuous material, and of such thickness and size to allow a force strong enough to set the a Ductmate clip without breakage.

4. The Ductmate clip setting tool of claim 1 wherein said lock base is a flattened rectangle; said lock base having a longitudinal fold of substantially 90 degrees angle which forms an inner leaf and an outer leaf; said arm being fixedly attached to said inner leaf, said outer leaf being distally disposed perpendicular to said arm and forming a mouth together with said setting rod.

5. The Ductmate clip setting tool of claim 1 wherein the distance between said lock base and said bridge is greater than the distance between said setting rod and said bridge.

6. The Ductmate clip setting tool of claim 1 wherein said setting rod is of substantially circular cross section.

7. The Ductmate clip setting tool of claim 1 wherein said bridge has a process extending beyond the point said brace is fixedly attached to said bridge and said process is perpendicular to said handle.

8. The Ductmate clip setting tool of claim 1 wherein said brace is substantially semicircular; said setting rod is diametrically attached to said brace; and said brace is attached to said bridge at a point distal to the attachment points of said setting rod.

* * * * *